United States Patent [19]

Vogelsong

[11] Patent Number: 5,070,928

[45] Date of Patent: Dec. 10, 1991

[54] FORMING PRESS WITH QUICK-CHANGE TOOL-TO-BOLSTER LOCKING MECHANISM

[75] Inventor: David L. Vogelsong, Defiance, Ohio

[73] Assignee: General Motors Corporation, Detroit, Mich.

[21] Appl. No.: 485,318

[22] Filed: Feb. 28, 1990

[51] Int. Cl.[5] ..... B22C 15/02; B22C 15/08

[52] U.S. Cl. ..... 164/207; 164/211; 164/172; 164/37

[58] Field of Search ..... 164/172, 169, 207, 37, 164/173, 212, 211

[56] References Cited

U.S. PATENT DOCUMENTS

| | | | |
|---|---|---|---|
| 23,687 | 7/1953 | Hursh | 164/173 |
| 4,063,586 | 12/1977 | Keller | 164/207 |
| 4,617,978 | 10/1986 | Damm | 164/37 |

FOREIGN PATENT DOCUMENTS

| | | | |
|---|---|---|---|
| 235517 | 2/1960 | Australia | 164/207 |
| 398547 | 7/1924 | Fed. Rep. of Germany | 164/207 |
| 1228962 | 5/1986 | U.S.S.R. | 164/169 |
| 137603 | 1/1920 | United Kingdom | 164/211 |
| 958269 | 5/1964 | United Kingdom | 164/211 |

OTHER PUBLICATIONS

*Metals Handbook*, vol. 5, "Forging and Casting", pp. 164–165, 8th Ed.

*Primary Examiner*—Richard K. Seidel
*Assistant Examiner*—Rex E. Pelto
*Attorney, Agent, or Firm*—Douglas D. Fekete

[57] ABSTRACT

A forming press, such as a foundry squeeze press, includes an axially movable bolster having locking hooks for engaging trunnions on a replaceable forming tool, such as a foundry sand squeeze board, to releasably secure the tool against the bolster and yet permit quick change-over from one forming tool to another to accommodate production of different workparts (e.g., mold copes or drags). The hooks are pivoted by a linear screw device to first positions wherein they are engaged with the trunnions. The hooks have pivot axes offset from the trunnion axes in such a manner as to impart such a component of motion along the bolster axis to the hooks when they are pivoted to the first positions as to tightly clamp the tool against the bolster. The hooks are pivotable by the linear screw device to second positions disengaged from the trunnions to free the forming tool for removal from the bolster.

15 Claims, 4 Drawing Sheets

FORMING PRESS WITH QUICK-CHANGE TOOL-TO-BOLSTER LOCKING MECHANISM

FIELD OF THE INVENTION

The present invention relates to a press, such as a foundry squeeze press, for forming workparts such as sand molds (e.g., copes and drags) at a work station using replaceable forming tools and a "quick-change" tool-to-bolster locking mechanism that permits quick change-over from one tool to another during a production run to accommodate production of different workparts.

BACKGROUND OF THE INVENTION

Squeeze presses are widely used in the foundry industry in the production of green sand molds each comprising a cope and drag. In a typical squeeze press, a metal pattern corresponding to the particular cope or drag to be produced is supported on a support plate atop a jolt table, a mold flask is positioned about the pattern and loose foundry sand is introduced into the mold flask about the pattern. The squeeze press includes a vertically movable bolster located above the work station for carrying a sand-forming tool (referred to by some as a squeeze board) specially configured or matched to the particular pattern in the mold flask so as to compress the loose sand uniformly about the pattern by downward movement of the bolster. The use of matched pattern/-squeeze board sets results in more uniform compaction of the loose sand about the particular pattern and in the production of more uniformly dimensioned molds. Improvements in dimensional control of the sand molds translates into corresponding improvements in the metal castings made in those molds.

During the production of sand molds using matched pattern/squeeze board sets, the squeeze press is stopped whenever a different sand mold (e.g., cope or drag) is to be produced during a production run in order to replace one pattern and squeeze board set with another set. In the past, replacement of the squeeze board has been a tedious and time-consuming operation in that numerous fasteners (e.g., machine screws) holding the squeeze board to the bolster must be manually removed to free the squeeze board for removal and replacement with another squeeze board that is matched to the particular replacement pattern to be positioned on the jolt table. The replacement squeeze board must then be fastened to the bolster in still another tedious and time-consuming manual operation.

As a result, there is a need to facilitate replacement of one squeeze board with another during a production run of sand molds. In particular, there is a need to reduce the manual labor and time involved in replacing one squeeze board for another on the bolster of the squeeze press while still insuring that the squeeze board is firmly secured to the bolster.

It is an object of the invention to satisfy this need as it relates particularly to foundry squeeze presses and as it relates more generally to other presses where more rapid change-over from one forming tool to another during a production run is desired.

It is another object of the invention to provide a forming press of the type having a bolster and a forming tool secured thereagainst wherein a "quick-change" tool-to-bolster locking mechanism is provided to facilitate change-over from one forming tool to another.

It is another object of the invention to provide a forming press of the type having a bolster and a forming tool secured thereagainst using a "quick-change" tool-to-bolster locking mechanism comprising a particular arrangement of hooks on the bolster and trunnions on the forming tool that are engageable in such a manner as to releasably secure the tool against the bolster and are readily disengageable in such a manner as to quickly free the forming tool for replacement with another tool.

SUMMARY OF THE INVENTION

The invention contemplates a forming press such as a foundry squeeze press of the type having a replaceable forming tool (such as a squeeze board for a foundry squeeze press) releasably secured to a bolster that is movable along an axis in a direction toward the work station wherein a "quick-change" tool-to-bolster locking mechanism is provided for releasably engaging a tool mounting surface against a bolster mounting surface. The tool-to-bolster locking mechanism comprises a pair of trunnions mounted on the forming tool in perpendicular orientation to the axis of bolster movement and in generally parallel, laterally spaced relationship to one another and a pair of hooks laterally spaced apart and pivotably mounted on the bolster. The hooks are mounted on the bolster for pivotal movement by hook pivoting means between first positions wherein each hook engages a corresponding trunnion to secure the tool mounting surface against the bolster mounting surface and second positions wherein each hook is released from the corresponding trunnion so as to permit the forming tool to be separated from the bolster for replacement with another forming tool.

Each hook has a pivot axis offset from a plane parallel to the corresponding trunnion engaged thereby so as to impart an axial component of motion to each hook as it is pivoted to the first position in a direction to urge the tool mounting surface tightly against the bolster mounting surface.

In one embodiment of the invention, the hooks are each disposed on a pivot pin mounted on the bolster and oriented parallel to the corresponding trunnion. Each pivot pin is offset outboard of the corresponding trunnion such that a desired axial component of motion is imparted to each hook as it pivots into engagement with the corresponding trunnion at the first position to urge the tool mounting surface against the bolster mounting surface and such that each hook is disposed outboard of the corresponding trunnion at the second position to permit the forming tool to be separated from the bolster.

In another embodiment of the invention, each hook includes a flat trunnion-contact surface for engaging a flat surface of the corresponding trunnion in a low angle fit when the hooks are moved to the first positions to facilitate locking engagement between the hooks and trunnions.

In another embodiment of the invention, a variable length linear screw device is connected at opposite ends to hook actuator arms that are pivotably mounted on the pivot pins and operatively connected to the hooks for pivoting therewith. The linear screw device is supported between the hook actuator arms and pivots the hooks via the actuator arms between the first positions (engaged with the trunnions) and the second positions (disengaged from the trunnions) to alternately secure and release the forming tool from the bolster.

In a forming press in accordance with the invention, replacement of the forming tool (e.g., the squeeze board in a foundry squeeze press) is greatly facilitated by virtue of the "quick-change" tool-to-bolster locking mechanism so as to significantly reduce manual labor and time required for the tool replacement operation.

The aforementioned objects and advantages of the invention will become more readily apparent from the following detailed description taken with the drawings.

DETAILED DESCRIPTION OF THE INVENTION

Figure 1:
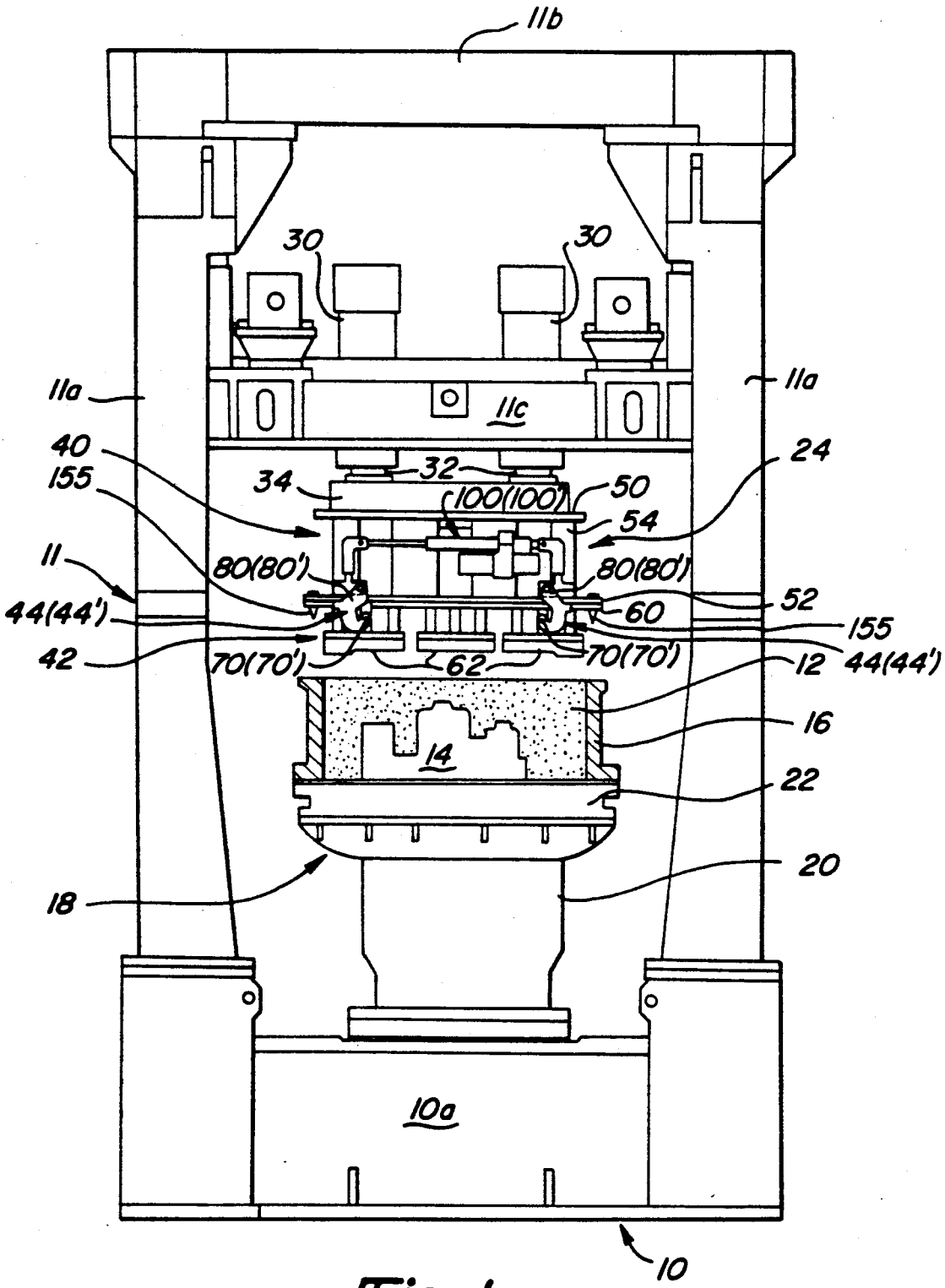
FIG. 1 is a elevational view of a foundry squeeze press in accordance with the invention. The mold flask is shown in section for clarity.

Referring to FIG. 1, a foundry squeeze press 10 is shown for compacting a body or mass 12 of loose mold sand (e.g., silica sand) about a pattern 14 disposed in a mold flask 16 at a work station 18. The compacted sand mass 12 forms a self-sustaining sand mold (e.g., a cope or drag) when it is subsequently separated from the pattern 14 and the flask 16 as is well known in the foundry art.

The work station 18 includes a jolt table 20 mounted on the base 10a of the press 10. A pattern holder or stool 22 is, in turn, mounted on the jolt table 20 for supporting the pattern 14 and the flask 16. The jolt table 20 is of a known type for initially jolting the flask 16 after it is filled with the mass 12 of sand to provide optional initial compaction of the sand prior to more complete compaction of the mass 12 using the squeeze head 24 to be described in more detail hereinbelow.

The press 10 includes a support frame 11 having laterally spaced apart, upstanding side frame members 11a and an upper, top frame member 11b therebetween. A cross-member 11c is supported in a horizontal plane between the side frame members 11a. Mounted on the cross-member 11c is a pair of hydraulic cylinders 30 having pistons 32 connected to a squeeze head support platen 34 such that the squeeze head 24 is moved toward or away from the work station 18 when the pistons 32 are extended or retracted, respectively.

Although forming no part of the present invention, the cross-member 11c may be movable horizontally between the side frame members 11b to position a sand chute (not shown) over the flask 16 at the work station 18 to fill it with the sand mass 12 and then position the squeeze head 24 over the sand-filled flask 16 as shown in FIG. 1 preparatory to compaction of the mass 12 about the pattern 14 by the squeeze head.

The squeeze head 24 comprises a bolster 40 fixedly secured to the support platen 34 and a replaceable forming tool 42 in the form of a squeeze board or plate releasably secured against the bolster 40 by "quick-change" tool-to-bolster locking mechanisms 44,44' to be described in detail hereinbelow.

The configuration of the forming tool (i.e., squeeze board) 42 is matched to the configuration of the particular pattern 14 in the flask 16 to provide uniform compaction of the mass 12 about the pattern 14. Typically, a plurality of pattern/squeeze board sets are stored in a storage area (not shown) of the mold production facility and are shuttled to and from the press 10 as needed during a production run to accommodate production of different sand molds (copes and drags).

The bolster 40 and the forming tool 42 are shown in more detail in FIGS. 2-5. In particular, the bolster 40 comprises an upper, horizontal plate 50, a lower, horizontal plate 52 and a plurality of upstanding supports 54 welded or otherwise secured therebetween. The upper plate 50 is fastened to the platen 34 by fasteners or other attachment means. The lower plate 52 includes a horizontal mounting surface 52a generally perpendicular to the vertical axis of movement of the bolster 40 and facing the underlying work station 18.

The replaceable forming tool (squeeze board) 42 comprises an upper, horizontal plate 60 and a plurality of lower, generally horizontal working segments 62 secured thereto by upstanding supports 64 welded or otherwise secured to the underside of the upper plate 60. The upper plate 60 includes an upper, horizontal mounting surface 60a adapted to be releasably secured against the bolster mounting surface 52a in a manner to be described. The squeeze board working segments 62 include respective lower working surfaces 62a appropriately configured for engaging the sand mass 12 and compacting the mass 12 evenly about the pattern 14 in the flask 16.

In accordance with the invention, "quick-change" tool-to-bolster locking mechanisms 44,44' are provided on opposite sides of the squeeze head 24 to releasably secure the forming tool 42 against the bolster 40; i.e., to secure the mounting surface 60a of the squeeze board against the bolster mounting surface 52a. Since each tool-to-bolster locking mechanism 44,44' is identical, the various like components thereof will be designated by the same reference numerals, the reference numerals for components on one side of the squeeze head 24 being unprimed and those for components on the other side of the squeeze head 24 being primed.

Figure 2:
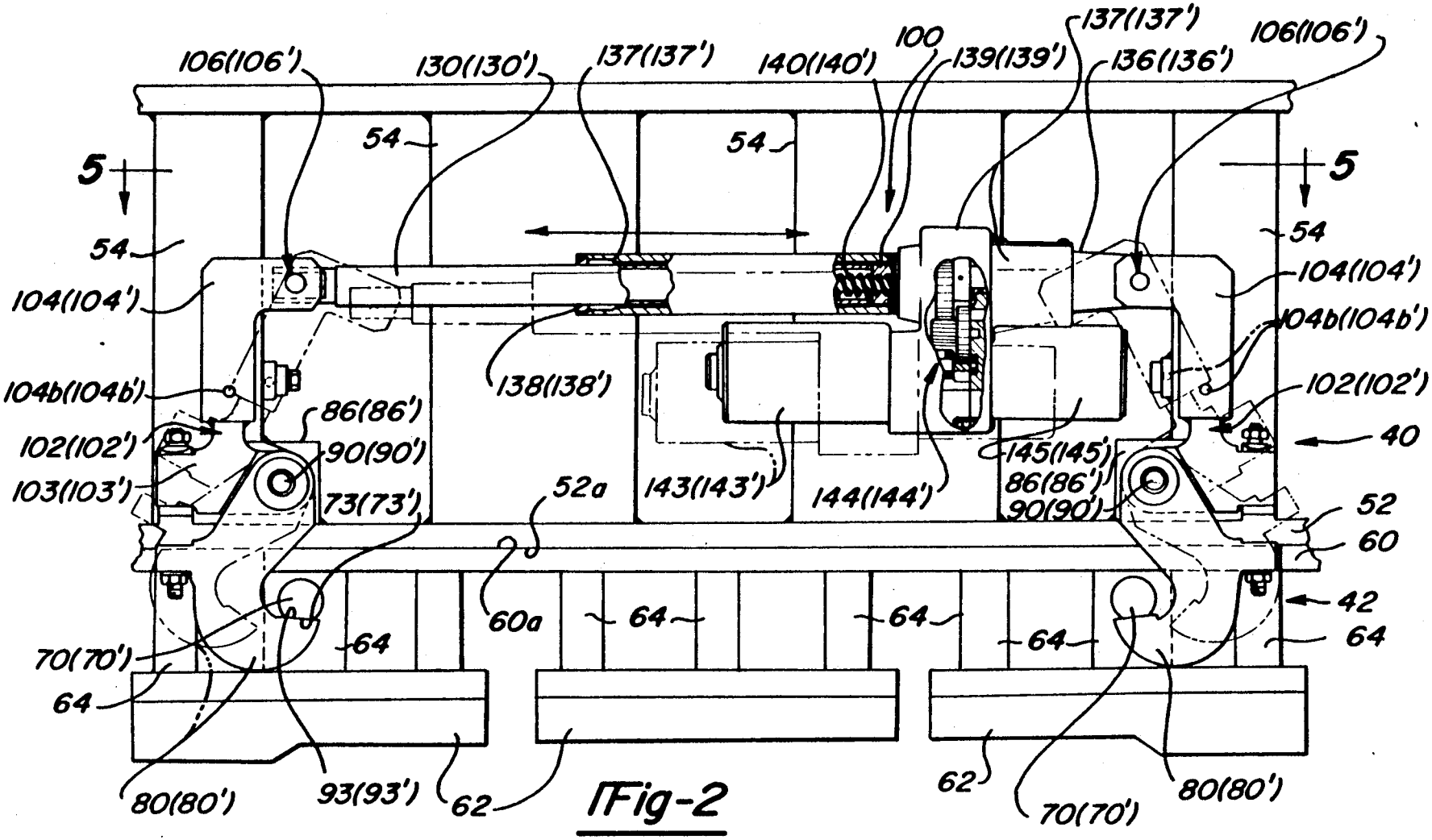
FIG. 2 is an enlarged elevational view of the bolster and the forming tool (i.e., squeeze board) with the hooks shown (in solid lines) engaged with the trunnions and shown (in phantom lines) disengaged outboard of the trunnions. The linear screw device is shown partially broken away for clarity.

In particular, the tool-to-bolster locking mechanisms 44,44' each comprise a pair of substantially parallel, horizontal cylindrical trunnions 70(70') spaced apart laterally on the side of the forming tool 42, one pair of trunnions 70 being shown in FIGS. 1-2. The other pair of trunnions 70' is disposed in like manner on the opposite side of the squeeze board 42. The longitudinal axis of each trunnion 70(70') is perpendicular to the vertical axis of movement of the bolster 40.

Figure 4:
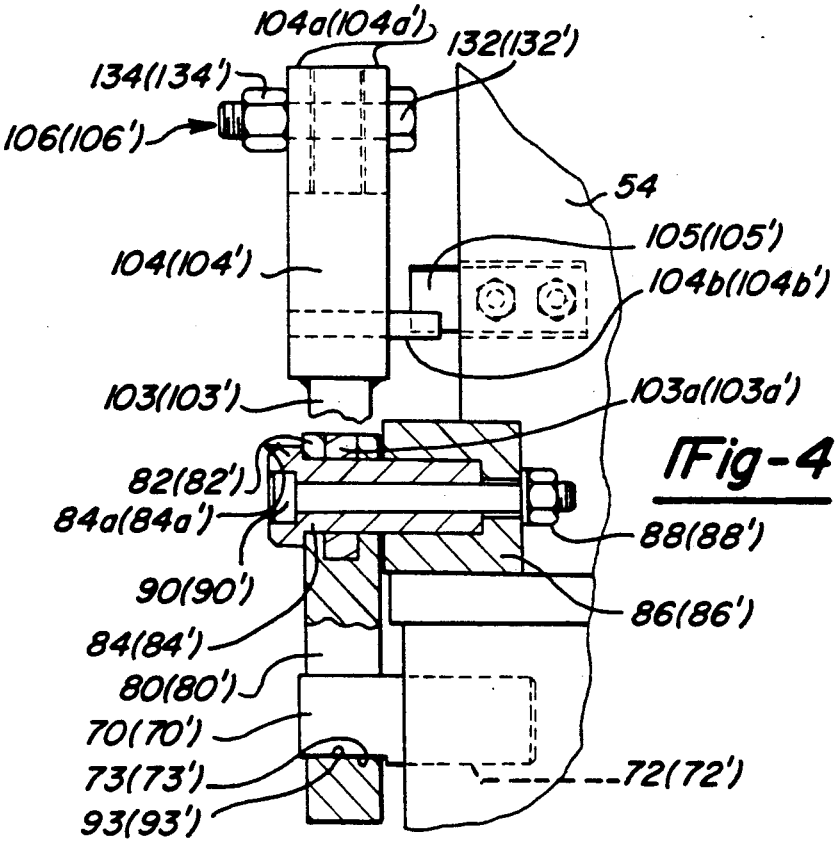
FIG. 4 is an elevational view, partially in section, taken along lines 4—4 of FIG. 3.

As shown best in FIG. 4, each trunnion 70(70') is press fit in a cylindrical bore 72(72') of the upstanding supports 64(64') of the forming tool 42, although other fastening techniques (e.g., welding) can also be employed to this end. Each trunnion 70(70') includes a slightly angled (e.g., 3° from horizontal) flat surface 73(73') on the underside thereof generally facing the work station 18 for reasons to be explained hereinbelow.

Each locking mechanism 44,44' also includes a pair of hooks 80(80') laterally spaced apart on the side of the bolster 40, one pair of hooks 80 being shown in FIGS. 1–2. The other pair of hooks 80' is disposed in like manner on the opposite side of the bolster 40. As shown in FIG. 4, each hook 80(80') includes an upper, end clevis 82(82') pivotably mounted on a corresponding pivot pin 84(84') that is received in a pin-receiving body 86(86') secured (e.g., welded) on the bolster 40. Each pivot pin 84(84') is fastened to the body 86(86') via nut 88(88') and bolt 90(90'), FIGS. 4–5, and includes an enlarged hook retaining head **84*a*(84*a*') to locate the hook 80(80')** thereon.

Each hook 80(80') is pivotable between a first position (shown in solid lines in FIG. 2) wherein a flat trunnion-contact surface 93(93') thereof engages the flat surface 73(73') of the corresponding adjacent trunnion 70(70') in a low angle fit and a second position (shown in phantom lines in FIG. 2) wherein the trunnion-contact surface 93(93') is outboard and disengaged from the flat surface 73(73') on the corresponding adjacent trunnion 70(70').

Figure 3:
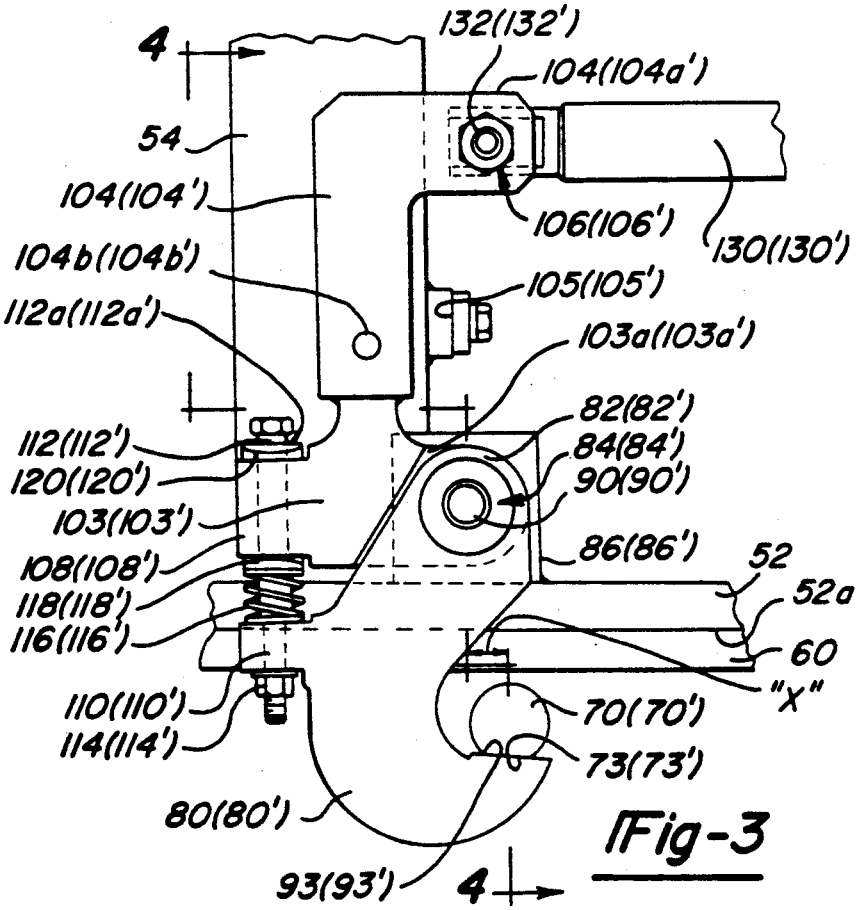
FIG. 3 is an enlarged elevational view of a hook of the locking mechanism engaged with a corresponding adjacent trunnion.

Importantly, as shown in FIGS. 2–3, each pivot pin 84(84') is laterally offset by a distance "X" outboard of a vertical plane through the longitudinal axis of the corresponding adjacent trunnion 70(70'). As will be described hereinbelow, this offset provides a vertical component of motion to the flat trunnion-contact surface 93(93') as each hook 80(80') pivots into engagement with the flat surface 73(73') of the corresponding adjacent trunnion 70(70') to urge the mounting surface **60*a* of the forming tool 42 tightly against the bolster mounting surface 52*a* to releasably secure the squeeze board 42 against the bolster 40 when the hooks 80(80') are in the first positions. When the hooks 80(80') are in the second positions, the forming tool 42 is freed for separation from the bolster 40**.

Figure 5:
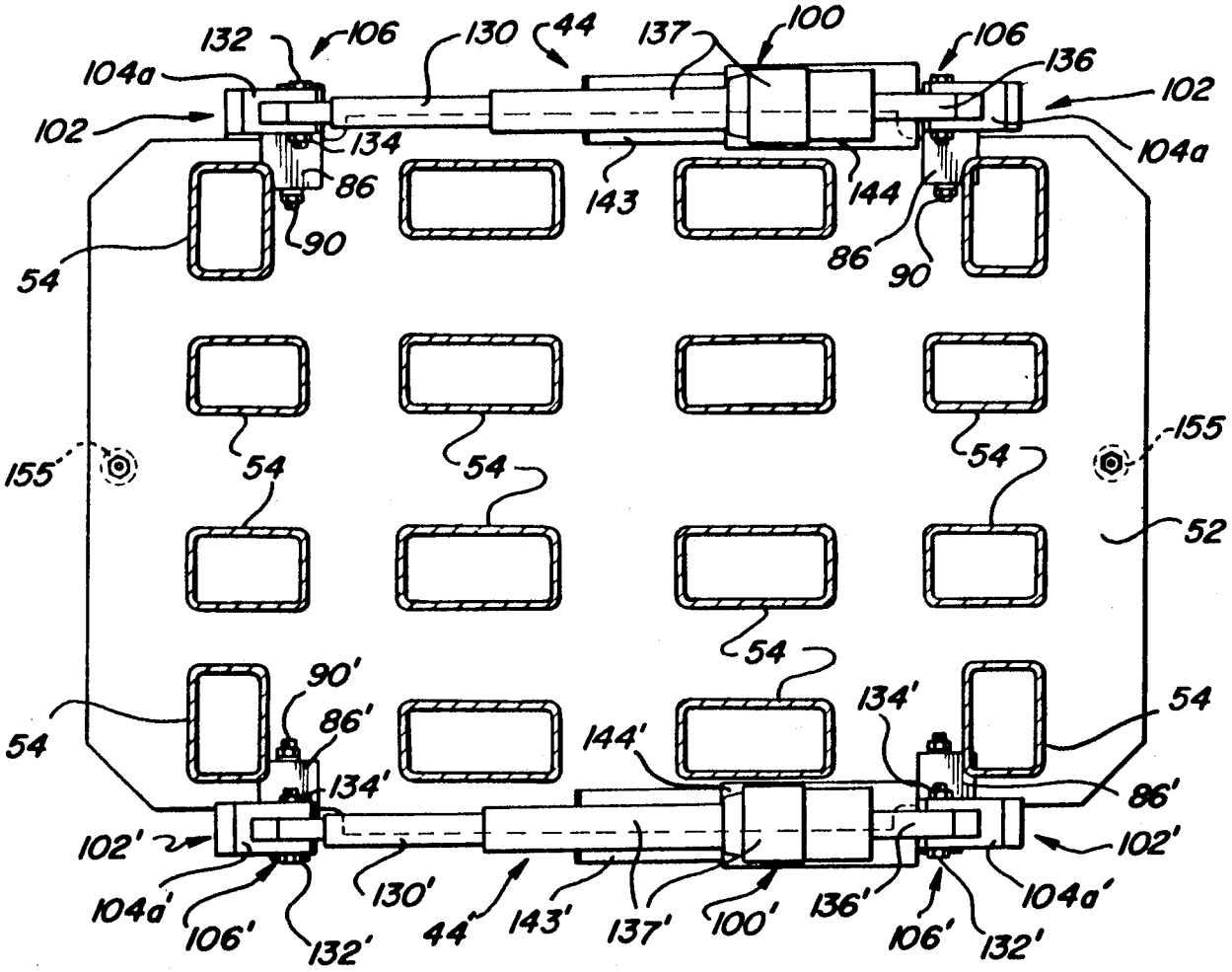
FIG. 5 is a elevational view of the bolster taken along lines 5—5 of FIG. 2 showing a linear screw device on each side of the bolster.

Referring to FIGS. 2 and 5, each tool-to-bolster locking mechanism 44,44' includes a variable length, linear screw device 100(100') for pivoting each pair of hooks 80(80') between the aforementioned first positions and second positions. In particular, each linear screw device 100(100') is operatively connected to a respective pair of the hooks 80(80') via hook actuator arms 102(102') that are also pivotably mounted on the pivot pins 84(84'). In particular, as shown best in FIGS. 3–4, each hook actuator arm 102(102') includes a body 103(103') having a tang **103*a*(103*a*') for receiving the pivot pin 84(84') and an L-shaped extension 104(104') having an end clevis 104*a*(104*a*') pivotably connected to the linear screw device 100(100') at connection sites 106(106')** as will be described in more detail hereinbelow.

Moreover, each hook actuator arm 102(102') includes a secondary lateral extension 108(108') that is operatively connected to a secondary extension 110(110') of the corresponding adjacent hook 80(80') by a bolt 112(112') and nut 114(114'). A coil spring 116(116') is provided between a washer 118(118') and the hook arm 110(110') to maintain tension on the hook 80(80') despite slight relative shifts in the position of the actuator arm 102(102') and the hooks 80(80') interconnected thereto. A shoulder **112*a*(112*a*') of the bolt 112(112') bears against an upper washer 120(120'). As a result of the operative interconnection between each actuator arm 102(102') and the corresponding hook 80(80'), they are pivoted together (i.e., in unison) on the pivot pin 84(84') by means of the linear screw device 100(100'). The springs 116(116') are at least slightly compressed when the hooks 80(80')** are in the aforementioned first positions for purposes to be explained.

As mentioned hereinabove, the hook actuator arms 102(102') are pivotably connected to the linear screw device 100(100') at connection sites 106(106'). In particular, the end clevis **104*a*(104*a*') of the left-hand actuator arms 102(102') in FIG. 2 is connected to a tubular shaft 130(130') of the linear device 100(100') via a bolt 132(132') and nut 134(134'). The end clevis 104*a*(104*a*') of the right hand actuator arm 102(102') in FIG. 2 is connected to extension 136(136') of the housing 137(137') of the linear screw device 100(100') via a like bolt 132(132') and nut 134(134'), FIGS. 3–5. As is apparent, the linear screw device 100(100') is supported between the hook actuator arms 102(102')**.

Referring to FIG. 2, the elongated tubular shaft 130(130') is connected by suitable fastening means (not shown) to an Acme screw nut 139(139') received in the housing 137(137'). A wiper-scraper seal 138(138') is provided at the open end of the housing 137(137') to keep dirt out and lubrication in the housing.

The tubular shaft 130(130') and the screw nut 139(139') are moved together either left or right in FIG. 2 by rotation of the Acme screw 140(140') that is threadably received in the ball nut 136(136'). Rotation of the screw 140(140') is effected by a 115V AC electric motor 143(143') drivingly connected to the screw 140(140') by gear train 144(144') in the housing 137(137'). A motor capacitor box 145(145') is carried on the housing 137(137').

Energization of the motor 143(143') drives the screw 140(140') in rotation through the gear train 144(144'), and the screw 140(140'), in turn, causes the screw nut 139(139') and tubular shaft 130(130') connected thereto to translate in one direction or the other depending upon the direction of rotation of the screw 140(140').

Referring to FIG. 2, the length or distance between the connection sites 106(106') of the linear screw device 100(100') is variable between a maximum first distance wherein the hooks 80(80') are in the first positions (solid lines) and a second shorter minimum distance wherein the hooks 80(80') are in the second positions (phantom lines). The distance between the connection sites 106(106') is reduced from the maximum distance to the minimum distance by retracting the tubular shaft 130(130') in FIG. 2 to the right toward the housing 137(137') as illustrated in phantom. Such movement of the tubular shaft 130(130') causes a corresponding equal, opposite movement of the housing 137(137') to the left in FIG. 2 as illustrated in phantom. Typically, the hook actuator arms 102(102') will be pivoted more or less concurrently (i.e., in unison). However, it may be possible for either the left hand hook actuator arm 102(102') or the right hand hook actuator arm 102(102') in FIG. 2 to trail the other in pivotal movement for some reason. If this non-unison actuator arm movement should occur, a roll pin **104*b*(104*b*') secured on the first moving actuator arm 102(102') will eventually abut (see phantom lines in FIG. 2) a fixed stop 105(105') on the bolster 40, allowing the trailing actuator arm 102(102') to catch up to the leading actuator arm 102(102') to position of the hooks 80(80') connected thereto in engagement with the trunnions 70(70')** at the first position.

The distance between the connection sites 106(106') is increased from the minimum distance to the maximum distance by movement of the tubular shaft 130(130') and the housing 137(137') in the reverse directions; i.e., from the phantom line positions to the solid line positions in FIG. 2.

Energization of the motor 143(143') to vary the distance between the connection sites 106(106') between the minimum and maximum distance is controlled by internal motor limit switches which are manually adjusted to this end. The variable length linear screw devices 100(100') described hereinabove are commercially available actuators available from Duff-Norton Company, P.O. Box 32605, Charlotte, N.C. 28232.

As mentioned hereinabove, during operation of the foundry squeeze press 10 shown in FIG. 1, the forming tool (squeeze board) 42 is used in conjunction with a particular pattern 14 as a matched set. As a result, the forming tool 42 is replaced with another forming tool 42 when the pattern 14 is replaced to accommodate production of a different mold. Replacement of the forming tool 42 is carried out when the bolster 40 is in the raised position shown in FIG. 1 in the manner now described.

In particular, removal of the forming tool 42 from the bolster 40 is effected by energization of the motors 143(143') to cause the linear screw devices 100(100') to contract to provide the aforesaid minimum distance between the connection sites 106(106') as shown in phantom in FIG. 2. This movement pivots the hooks 80(80') to the second positions (shown in phantom lines) outboard of the trunnions 70(70') to free (unclamp) the forming tool 42 for removal typically with the aid of a squeeze board shuttle (not shown) onto which the removed squeeze board is placed for transport to a storage area. A replacement forming tool 42 is then shuttled under the bolster 40 with the trunnions 70(70') thereof aligned appropriately relative to the pivot pines 84(84') of the bolster 40 using alignment pins 155 on the bolster 40 that mate in bushings (not shown) in the plate 60 of the tool 42. This alignment provides the desired offset relationship described hereinabove. The motors 143(143') are then energized to extend the tubular shafts 130(130') and the housings 137(137') to provide the aforesaid maximum length between the connection sites 106(106'). This movement causes the hooks 80(80') to pivot toward the corresponding adjacent trunnion 70(70') to place the trunnion-contact surfaces 93(93') in the first positions (shown in solid lines) in a low angle fit engagement with the trunnion surfaces 73(73'). As a result of the aforementioned offset of the pivot pins 84(84') relative to the vertical planes through the trunnions 70(70'), a vertical component of motion is imparted to the trunnion-contact surfaces 93(93') as they engage the surfaces 73(73') to tightly clamp the squeeze head mounting surface **60*a* against the bolster mounting surface 52*a*. The compression springs 116(116') between the extensions 108(108') and 110(110') of the actuator arms 102(102') and the hooks 80(80') are at least slightly compressed when the surfaces 73(73') and 93(93') are engaged. The springs 116(116') thereby bias the hooks 80(80') in a direction of engagement with the trunnions 70(70') to insure optimum engagement therebetween even if there is slight relative movement between the surfaces 73(73') and 93(93')** from vibration, shaking or other causes.

As is apparent, removal of one forming tool 42 for replacement with another is greatly facilitated in terms of the manual labor and time required as a result of the "quick-change" tool-to-bolster locking mechanisms 44,44' described hereinabove. Downtime of the foundry squeeze press 10 attributable to squeeze board replacement is thereby reduced to improve the production rate of sand molds of different types during a production run.

Although the invention has been illustrated hereinabove with respect to a foundry squeeze press, those skilled in the art will appreciate that the invention is not so limited and may find use in other types of presses wherein a replaceable forming tool is employed to form or work a series of workparts at a workstation. For example, the invention may find use in a sheet metal forming press for securing a replaceable forming die to a bolster of the press.

Moreover, while the invention has been described in terms of specific embodiments thereof, it is not intended to be limited thereto but rather only to the extent set forth hereafter in the claims which follow.

The embodiments of the invention in which an exclusive property or privilege is claimed are defined as follows:

1. In a press for forming a workpart located at a workstation, said press comprising a bolster movable along an axis in a direction toward the workstation and having a mounting surface generally perpendicular to the axis facing the workstation, a replaceable forming tool having a mounting surface releasably engageable against said bolster mounting surface and a working surface facing the workstation for forming the workpart, and a locking mechanism for releasably securing the tool against the bolster, said mechanism comprising:

a pair of trunnions mounted on the tool perpendicular to said axis and in parallel, laterally spaced relationship to each other, a pair of laterally spaced hooks pivotally mounted on the bolster, each hook being pivotable between a first position wherein the said hook engages a trunnion to secure the tool on the bolster and a second position wherein the hook is free from the trunnion so as to permit the tool to be axially separated from the bolster, each said hook having a pivot axis offset from a vertical plane through the longitudinal axis of the trunnion engaged thereby so as to produce a component of motion to the hook along the bolster axis as the hook pivots into engagement with the trunnion for urging the tool mounting surface against the bolster mounting surface, and means for pivoting the hooks between the first positions and the second positions to alternately secure the tool against the bolster and release the tool from the bolster.

2. The press of claim 1 wherein each trunnion includes a flat surface facing the workstation and each hook includes a flat, trunnion-contact surface for engaging said flat surface of the corresponding trunnion when the hooks are in the first positions.

3. The press of claim 1 wherein the pivot axis of each hook is offset outboard of said plane.

4. The press of claim 1 wherein each hook is pivotally mounted on a pivot pin mounted on the bolster parallel to the trunnions.

5. The press of claim 4 further including a hook actuator arm pivotably mounted on the pivot pin and operatively connected to the hook.

6. The press of claim 5 wherein said pivoting means comprises a device connected between the hook actuator arms for varying the distance between the hook actuator arms between a first distance wherein said hooks are in said first positions and a second distance wherein said hooks are in said second positions.

7. The press of claim 6 wherein said device is supported between said hook actuator arms.

8. The press of claim 5 wherein each hook and each actuator arm are connected at opposing extensions having spring means disposed therebetween to bias each hook in a direction toward engaging the corresponding trunnion at the first position.

9. In a squeeze press of a type employed in a foundry industry to compress a body of foundry sand about a pattern at a workstation to form a self-sustaining mold, said press comprising a vertically movable bolster disposed above the workstation and having a mounting surface facing the workstation, a replaceable forming tool having a mounting surface releasably engageable against said bolster mounting surface and a working surface generally opposite the mounting surface for engaging the material for forming, and a locking mechanism for releasably securing the tool against the bolster, said mechanism comprising:

a pair of horizontal trunnions mounted on the tool in parallel, horizontally spaced relationship, a pair of horizontal pivot pins mounted on the bolster parallel to the trunnions, a pair of hooks, one said hook mounted on each said pivot pin and comprising a trunnion-contact surface, each said hook being pivotable between a first position wherein said hook surface engages a corresponding trunnion to secure the tool on the bolster and a second position wherein the hook is disposed outboard from the trunnion so as to permit the tool to be vertically separated from the bolster, each said pin being disposed laterally offset from a vertical plane through the longitudinal axis of the corresponding trunnions so as to produce a vertical component of motion to the trunnion-contact surface as the hook pivots into engagement with the trunnion for urging the tool mounting surface against the bolster mounting surface, a pair of hook actuator arms, one said arm pivotably mounted on each said pivot pin and operatively connected to the hook mounted on the pin so as to pivot in conjunction therewith between a first position corresponding to the hook first position and a second position corresponding to the hook second position, and means for pivoting the actuator arms to pivot the hooks between the first positions and the second positions to alternately secure and release the tool from the bolster.

10. The press of claim 9 wherein said pivoting means comprises a device connected between the hook actuator arms for varying the distance between the hook actuator arms between a first distance wherein said hooks are in said first positions and a second distance wherein said hooks are in said second positions.

11. The press of claim 10 wherein said device is supported between said hook actuator arms.

12. The press of claim 9 wherein each hook and each actuator arm are connected at opposing extensions having a spring means disposed therebetween to bias each hook in a direction toward engaging the corresponding trunnion at the first position.

13. In a foundry squeeze press for compacting a body of mold sand about a pattern at a workstation, said squeeze press comprising a vertically movable bolster disposed above the workstation and having a mounting surface facing the workstation, a replaceable forming tool having a mounting surface releasably engageable against said bolster mounting surface and a mold sand working surface generally opposite the mounting surface, and a locking mechanism for releasably securing the tool against the bolster, said mechanism comprising:

first and second horizontal trunnions mounted on the tool in parallel, laterally spaced relationship and having flat surfaces generally facing the workstation, first and second horizontal pivot pins mounted on the bolster parallel to the trunnions laterally outboard therefrom, first and second hooks mounted respectively on said first and second pivot pins and comprising flat trunnion-contact surfaces, each said hook pivotable between a first position wherein said trunnion-contact surface engages a said flat surface of a corresponding trunnion to secure the tool on the bolster and a second position wherein the hook is disposed outboard from the trunnion so as to permit the tool to be vertically separated from the bolster, whereby said outboard arrangement of said pivot pins relative to said trunnions imparts a vertical component of motion to the hook trunnion-contact surfaces as the hooks pivots into engagement with the trunnions for urging the tool mounting surface against the bolster mounting surface, first and second hook actuator arms pivotably mounted on said first and second pivot pins respectively, said arms each being operatively connected to a said hook mounted on the pin so as to pivot in conjunction therewith, each said actuator arm having an extension comprising a connection site remote from the pin, and a variable length linear screw device comprising first and second opposite ends, each end being connected to a said connection site of a said hook actuator arm, said device having a first length between ends corresponding to the distance between the hook actuator arm connection sites when the hooks are in the first positions and a second, relatively shorter length corresponding to the distance between the hook actuator connection sites of the hooks in the second position, whereby adjustment of the length of the device is effective to concurrently pivot the first and second hooks between the first positions and the second positions to alternately secure and release the tool from the bolster.

14. The press of claim 13 wherein the linear screw device is supported between said hook actuator arms by connection of said first and second ends thereof to said connection sites.

15. The press of claim 14 wherein said first end comprises an end of a linearly movable shaft of said device and said second end comprises a housing extension of said device.

* * * * *